United States Patent [19]

Van Steenwyk

[11] Patent Number: 4,461,088

[45] **Date of Patent: * Jul. 24, 1984**

[54] SURVEY APPARATUS AND METHOD EMPLOYING CANTED TILT SENSOR

[75] Inventor: Brett H. Van Steenwyk, San Marino, Calif.

[73] Assignee: Applied Technologies Associates, San Marino, Calif.

[ * ] Notice: The portion of the term of this patent subsequent to May 5, 1998 has been disclaimed.

[21] Appl. No.: 258,896

[22] Filed: Apr. 30, 1981

Related U.S. Application Data

[63] Continuation of Ser. No. 36,328, May 7, 1979, Pat. No. 4,265,028.

[51] Int. Cl.[3] ..... G01C 19/38; E21B 4/024

[52] U.S. Cl. ..... 33/304; 33/312; 33/313; 33/366

[58] Field of Search ..... 33/304, 324, 321, 312, 33/302, 318, 313, 366

[56] References Cited

U.S. PATENT DOCUMENTS

| | | | |
|---|---|---|---|
| 2,309,905 | 2/1943 | Irwin et al. . | |
| 2,635,349 | 4/1953 | Green . | |
| 2,674,049 | 4/1954 | James . | |
| 2,681,567 | 6/1954 | Widess . | |
| 3,037,295 | 6/1962 | Roberson . | |
| 3,052,129 | 9/1962 | Rocks . | |
| 3,137,077 | 6/1964 | Rosenthal . | |
| 3,241,363 | 3/1966 | Alderson et al. . | |
| 3,561,129 | 2/1971 | Johnston . | |
| 3,753,296 | 8/1973 | Van Steenwyk . | |
| 3,894,341 | 7/1975 | Kapeller . | |
| 4,197,654 | 4/1980 | Van Steenwyk et al. | 33/324 X |
| 4,265,028 | 5/1981 | Van Steenwyk | 33/304 |

*Primary Examiner*—William D. Martin, Jr.
*Attorney, Agent, or Firm*—William W. Haefliger

[57] ABSTRACT

A borehole mapping and/or navigational instrument includes a carrier movable lengthwise in the borehole; structure on the carrier defining an axis of rotation; and a tilt sensitive device rotatable about the axis of rotation, that device having a tilt sensitive axis with components along the axis of rotation and along perpendiculars to that axis. One or more angular rate sensors may be provided to be rotatable about the axis of rotation.

17 Claims, 14 Drawing Figures

SURVEY APPARATUS AND METHOD EMPLOYING CANTED TILT SENSOR

This is a continuation of application Ser. No. 36,328, filed May 7, 1979, now U.S. Pat. No. 4,265,028.

BACKGROUND OF THE INVENTION

This invention relates generally to bore-hole and well mapping navigation, and more particularly concerns apparatus and method to remotely determine tilt from vertical, in a bore-hole.

At the present time it is customary to employ three-axis accelerometer packages or assemblies to accurately determine tilt in a bore-hole. In general, three accelerometers are required, and are mounted in mutually orthogonal relationship to measure gravity components in the Z-direction of the hole axis, and also in X and Y directions at right angles to one another and also perpendicular to the Z axis. The output of each accelerometer is then measured, and a resultant vector constructed to determine the direction of tilt. For low tilt angles (i.e. near vertical) the outputs from the X and Y direction sensing accelerometers provide the useful signal, whereas for high tilt angles the output from the Z direction sensing accelerometer becomes the most sensitive and accurate.

U.S. Pat. No. 3,753,296 to Donald H. Van Steenwyk describes a technique whereas a single accelerometer is rotated about the Z axis, that accelerometer having its tilt sensitive axis perpendicular to the Z axis and thereby sweeping through the X and Y field directions upon rotation. Such rotation enables one accelerometer to take the place of the two (X and Y direction sensing) accelerometers described above. Besides eliminating fixed errors and bias errors, such a rotary or carouseling arrangement realizes many other advantages inasmuch as, depending upon the speed and accuracy of rotation, statistical leverage can significantly improve tilt determination. Thus, improved accuracy, lower cost and simplified tilt measurement can be realized. However, for very high tilt angles, such accuracy rapidly diminishes, and a significant problem remains.

SUMMARY OF THE INVENTION

It is a major object of the invention to provide a solution to the above described problem. Basically, the invention contemplates use of a single accelerometer to take the place of all three X, Y and Z direction sensing accelerometers referred to above. The single accelerometer is adapted to be carouseled or rotated about an axis defined on a carrier movable lengthwise of the bore-hole; and the tilt sensitive axis of the single accelerometer is oriented in a "cant" direction characterized as having components respectively along the axis of rotation and also along a perpendicular to that axis. Since the accelerometer is rotated, its tilt sensitive axis then effectively has components along the X and Y directions normal to the Z axis, whereby components along all three axes are provided.

Carouseling of a single accelerometer gains the benefits of high accuracy, as will be further discussed; and it also takes the place of two or three accelerometers such as were previously required, to gain a cost advantage. As will also appear, the cant angle should be between about 5° and 40° as measured from the X-Y plane normal to the Z-axis (the axis of rotation).

These and other objects and advantages of the invention, as well as the details of an illustrative embodiment, will be more fully understood from the following description and drawings in which:

DRAWING DESCRIPTION

Figure 1:
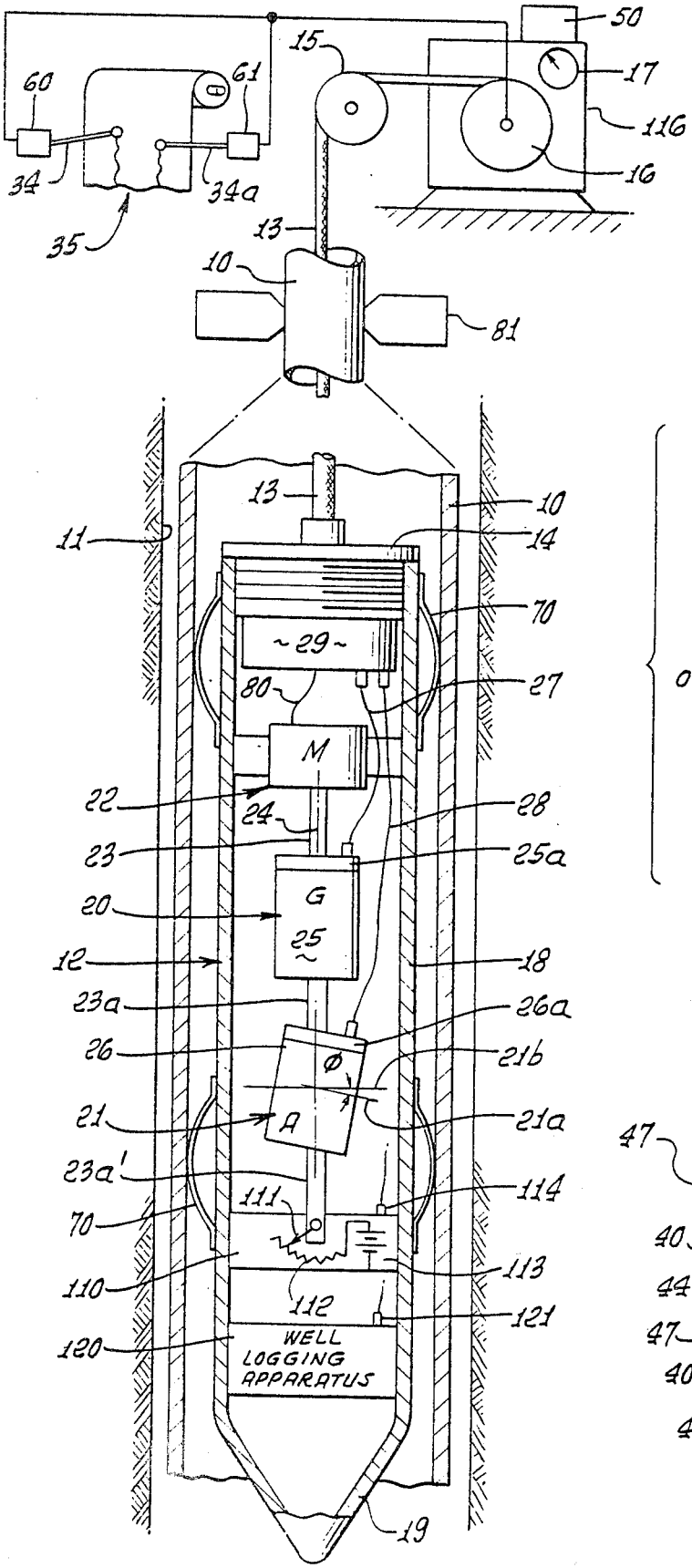
FIG. 1 is an elevation taken in section to show use of one form of instrument of the invention, in well mapping.
Figure 5:
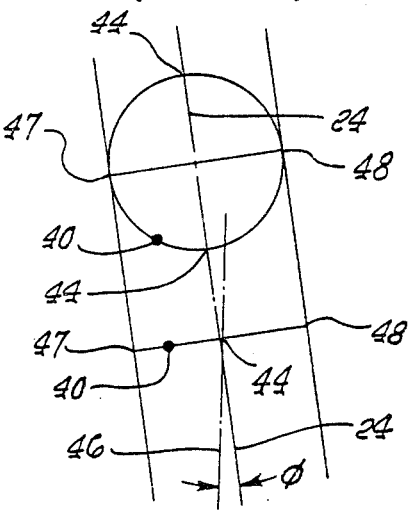
Figure 4:
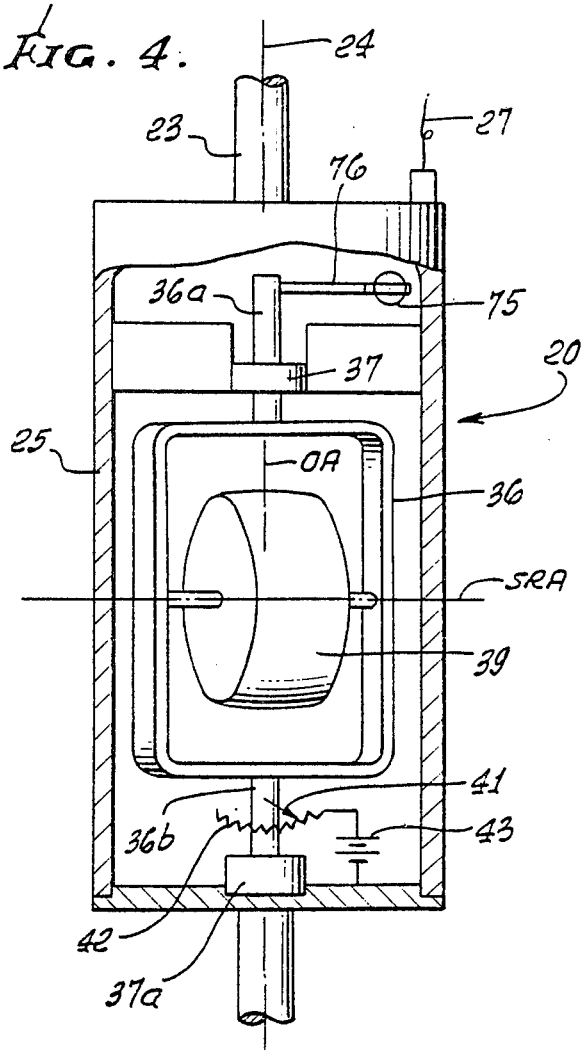
Figure 4A:
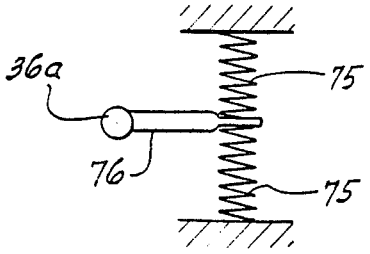
Figure 4B:
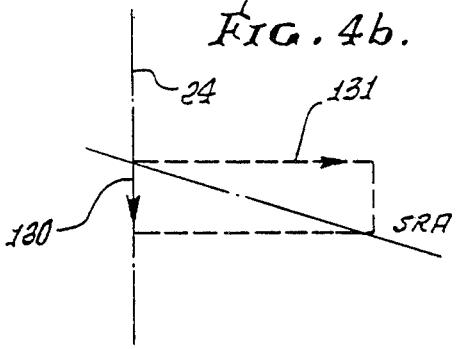
Figure 7:
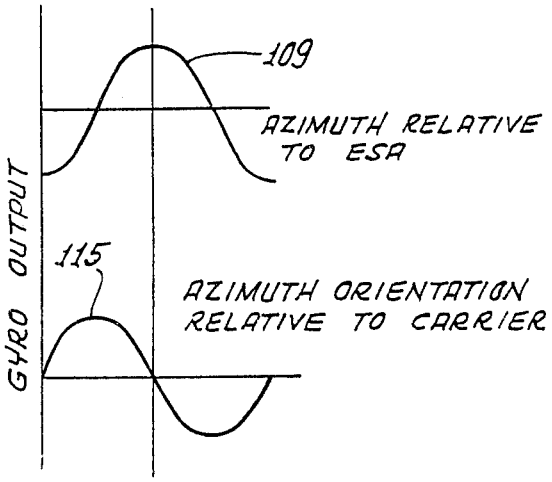
Figure 8:
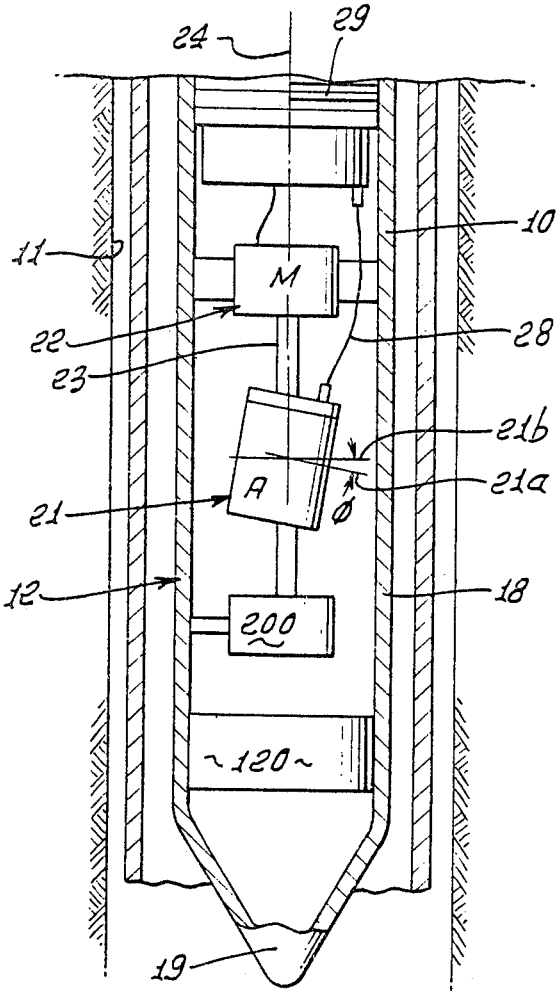
Figure 6:
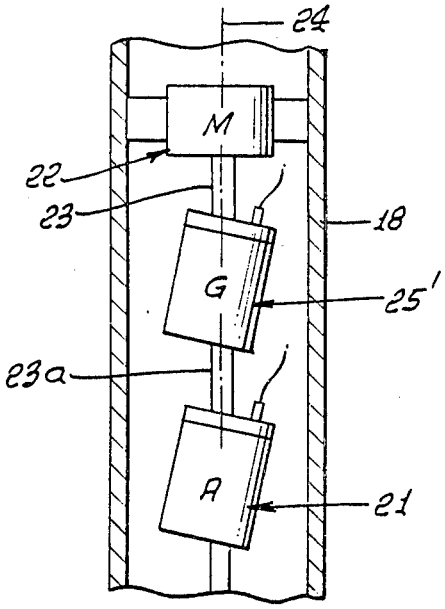
Figure 9:
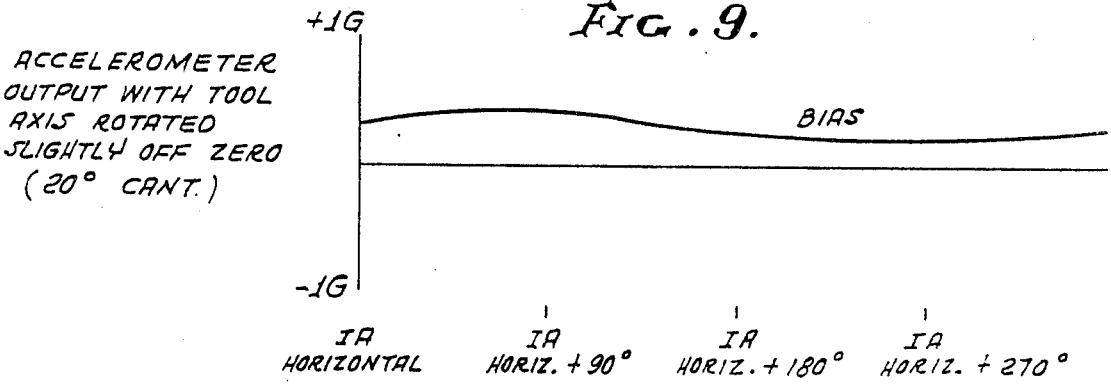
Figure 10:
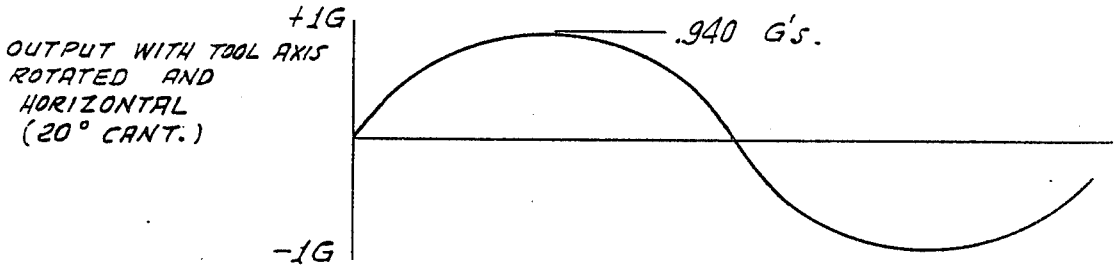
Figure 11:
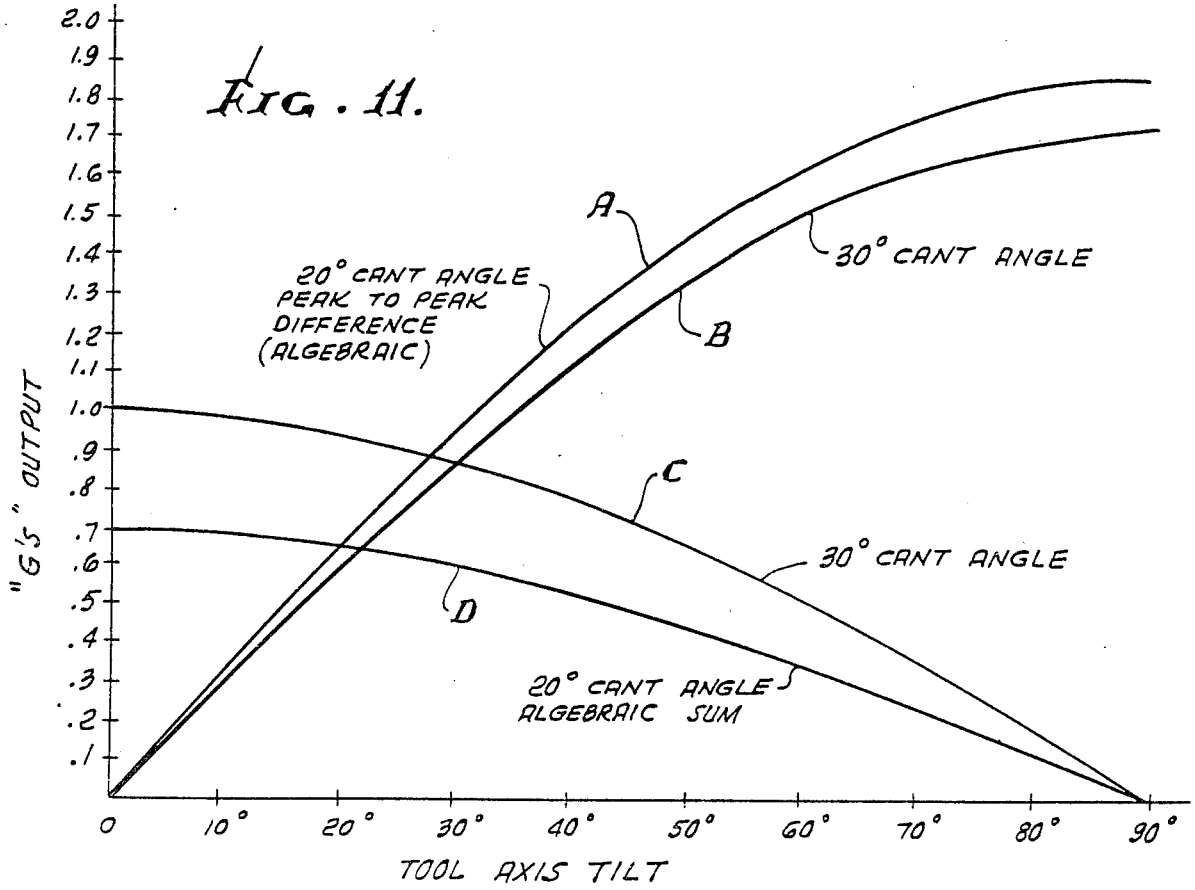

FIGS. 4 and 4*a* are schematic showings of a single degree of freedom gyroscope as may be used in the apparatus of FIG. 1; and FIG. 4*b* is a spin axis component diagram;

FIG. 5 is a diagrammatic showing of the operation of the accelerometer under instrument tilted conditions;

FIG. 6 is a view like FIG. 1, and showing a modified form of the invention;

FIG. 7 is a wave form diagram;

FIG. 8 is a view like FIG. 1, and showing another modified form of the invention;

FIGS. 9–11 are graphs; and

Figure 12:
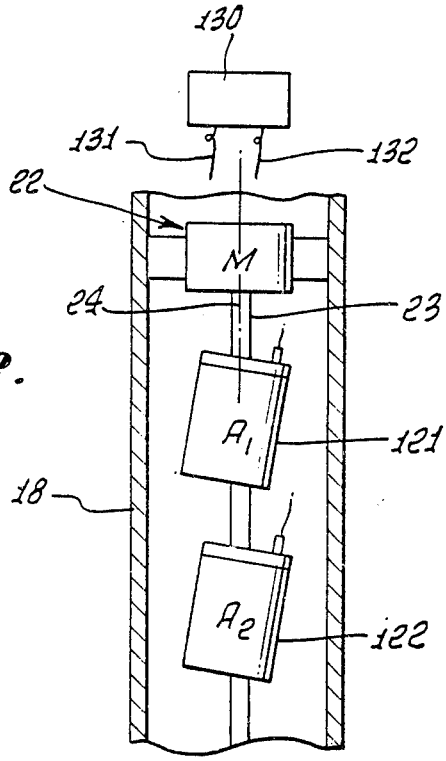

FIG. 12 shows a further modification.

DETAILED DESCRIPTION

In FIG. 1, well tubing 10 extends downwardly in a well 11, which may or may not be cased. Extending within the tubing in a well mapping instrument or apparatus 12 for determining the direction of tilt, from vertical, of the well or bore-hole. Such apparatus may readily be traveled up and down in the well, as by lifting and lowering of a cable 13 attached to the top 14 of the instrument. The upper end of the cable is turned at 15 and spooled at 16, where a suitable meter 17 may record the length of cable extending downwardly in the well, for logging purposes.

The apparatus 12 is shown to include a generally vertically elongated tubular housing or carrier 18 of diameter less than that of the tubing bore, so that well fluid in the tubing may readily pass, relatively, the instrument as it is lowered in the tubing. Also, the lower terminal of the housing may be tapered at 19, for assisting downward travel or penetration of the instrument through well liquid in the tubing. The carrier 18 supports an angular rate sensor such as a rate gyroscope 20, accelerometer 21, and drive means 22 to rotate the latter, for travel lengthwise in the well. Bowed springs 70 on the carrier center it in the tubing 10.

The drive means 22 may include an electric motor and speed reducer functioning to rotate a shaft 23 relatively slowly about axis 24 which is generally parallel to the length axis of the tubular carrier, i.e., axis 24 is vertical when the instrument is vertical, and axis 24 is tilted at the same angle from vertical as is the instrument when the latter bears sidewardly against the bore of the tubing 10 when such tubing assumes the same tilt angle due to bore-hole tilt from vertical. Merely as illustrative, the rate of rotation of shaft 23 may be within the range 0.5 RPM to 5 RPM. The motor and housing may be considered as within the scope of primary means to support and rotate the gyroscope and accelerometer. The sensitive axis 21*a* of the accelerometer is shown as tilted at angle $\phi$ from a plane 21*b* which is normal to axis 24. The sensitive axis 21*a* is an acceleration sensitive or input axis.

Due to rotation of the shaft 23, and a lower extension 23*a* thereof, the frame 25 of the gyroscope and the canted frame 26 of the accelerometer, and tilted axis 21*a*, are all rotated simultaneously about axis 24, within and relative to the sealed housing 18. The signal outputs of the gyroscope and accelerometer are transmitted via terminals at suitable slip ring structures 25*a* and 26*a*, and via cables 27 and 28, to the processing circuitry at 29 within the instrument, such circuitry for example including a suitable amplifier or amplifiers, and multiplexing means, if desired. The multiplexed or non-multiplexed output from such circuitry is transmitted via a lead in cable 13 to a surface recorder, as for example includes pens 34 and 34*a* of a strip chart recorder 35, whose advancement may be synchronized with the lowering of the instrument in the well. The drivers 60 and 61 for recorder pens 34 and 34*a* are calibrated to indicate bore-hole azimuth and degree of tilt, respectively, the run-out of the strip chart indicating bore-hole depth along its length.

Turning to FIG. 4, the gyroscope 20 is schematically indicated as having its frame 25 rotated about upward axis 24, as previously described. A sub-frame 36 of the gyroscope has shafts 36*a* and 36*b* bearing supported at 37 and 37*a* by the frame 25, to pivot about output axis OA which is parallel to axis 24. The gyroscope rotor 39 is suitably motor driven to rotate about spin reference axis SRA which is normal to axis OA and which typically is generally normal to axis 24 although it is shown rotated out of that position in FIG. 4. The rotor is carried by sub-frame 36, to pivot therewith and to correspondingly rotate the wiper 41 in engagement with resistance wire 42 connected with DC source 43. The sub-frame 36 is yieldably biased against rotation about axis OA and relative to the housing 25, as by compression springs 75 (or their electrical equivalents) carried by the housing and acting upon the arm 76 connected to shaft 36*a*, as better seen in FIG. 4*a*.

In FIG. 4 the "input" or "sensitive" axis of the "sensor" (such as the gyroscope, for example ) is normal to and intersects the designated OA and SRA axes.

Figure 3:
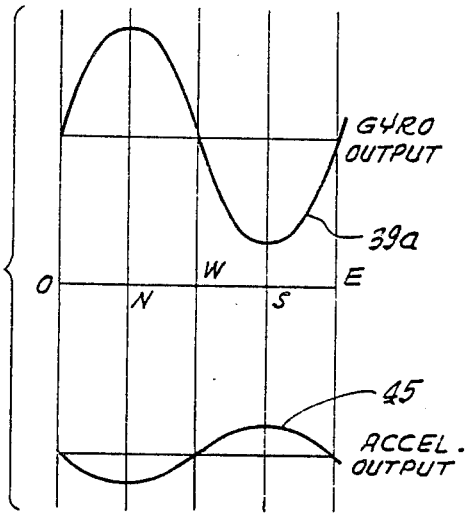
FIG. 3 is a wave form diagram.

Accordingly, the current flow via the wiper is a function of pivoting of the sub-frame 36 about axis OA, which is in turn a function of rotary orientation of the frame 25 with respect to a North-South longitudinal plane through the instrument in the well. As seen in FIG. 3, the gyroscope may be rotated about axis 24 so that its signal output 39*a* is maximized when spin reference axis SRA passes through the North-South longitudinal plane, and is zero when that axis is normal to that plane. One usable gyroscope is model GI-G6, a product of Northrop Corporation.

Figure 2:
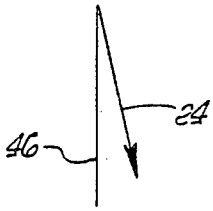
FIG. 2 is a diagram indicating tilt of the well mapping tool in a slanted well.

The accelerometer 21, which is simultaneously rotated with the gyroscope, has an output as represented for example at 45 under instrument tilted conditions corresponding to tilt of axis 24 in North-South longitudinal plane; i.e. the accelerometer output is maximized when the gyroscope output indicates South alignment, and again maximized when the gyroscope output indicates North alignment. FIG. 2 shows tilt of axis 24 from vertical 46, and in the North-South plane, for example. Further, the accelerometer maximum output is a function of the degree of such tilt, i.e. is higher when the tilt angle increases and vice versa; therefore, the combined outputs of the gyroscope and accelerometer enable ascertainment of the azimuthal direction of bore-hole tilt, at any depth measured lengthwise of the bore-hole, and the degree of that tilt.

FIG. 5 diagrammatically illustrates the functioning of the accelerometer in terms of rotation of a mass 40 about axis 24 tilted at angle $\phi$ from vertical 46. As the mass rotates through points 44 at the level of the intersection of axis 24 and vertical 46, its rate of change of velocity in a vertical direction is zero; however, as the mass rotates through points 47 and 48 at the lowest and highest levels of its excursion, its rate of change of velocity in a vertical direction is at a maximum, that rate being a function of the tilt angle $\phi$. A suitable accelerometer is that known as Model 4303, a product of Systron-Donner Corporation, of Concord, Calif.

Control of the angular rate of rotation of shaft 23 about axis 24 may be from surface control equipment indicated at 50, and circuitry 29 connected at 80 with the motor. Means (as for example a rotary table 81) to rotate the drill pipe 10 during well mapping, as described, is shown in FIG. 1.

Referring to FIGS. 1 and 7, the gyroscope is characterized as producing an output which varies as a function of azimuth orientation of the gyroscope relative to the earth's spin axis, that output for example being indicated at 109 in FIG. 7 and peaking when North is indicated. Shaft 23 may be considered as a motor rotary output element which may transmit continuous unidirectional drive to the gyroscope. Alternatively, the shaft may transmit cyclically reversing rotary drive to the gyroscope. Further, the structure 22 may be considered as including servo means responsive to the sensor or gyroscope output to control the shaft 23 so as to maintain the gyroscope with predetermined azimuth orientation, i.e. the axis SRA may be maintained with direction such that the output 109 in FIG. 7 remains at a maximum or any other desired level.

Also shown in FIG. 1 is circuitry 110, which may be characterized as a position pick-off, for referencing the gyroscope output to the case or housing 18. Thus, that circuitry may be connected with the motor (as by wiper 111 on shaft 23*a*' turning with the gyroscope housing 20 and with shaft 23), and also connected with the carrier 18 (as by slide wire resistance 112 integrally attached to the carrier via support 113), to produce an output signal at terminal 114 indicating azimuthal orientation of the gyroscope relative to the carrier. That output also appears at 115 in FIG. 7. As a result, the outputs at terminal 114 may be processed (as by surface means generally shown at 116 connected to the instrumentation by cable 13) to determine or derive azimuthal data indicating orientation of the carrier relative to the earth's spin axis. Such information is often required, as where it is desired to know the orientation of well logging apparatus being run in the well. Item 120 in FIG. 1 may be considered, for example, as well logging apparatus the output of which appears at 121. Carrier 18 supports item 120, as shown. Merely for purpose of illustration, such apparatus may comprise an inclinometer to indicate the inclination of the bore-hole from vertical, or a radiometer to sense radiation intensity in the hole.

It will be understood that the recorder apparatus may be at the instrument location in the hole, or at the surface, or any other location. Also, the control of the motor 29 may be pre-programmed or automated in some desired manner.

FIG. 8 shows a modified tool, which remains the same as in FIG. 1, except that the gyroscope is eliminated. The motor or drive 22 rotates the accelerometer 21, only. The pick-off for the accelerometer is generally indicated at 200, and includes elements depicted at 110–114 in FIG. 1.

FIGS. 9 and 10 show accelerometer outputs during rotation of the tool (as in FIGS. 1 or 8), and for different conditions. In each graph, the accelerometer cant angle $\phi$ is 20°; however, in FIG. 9, the tool axis 24 is very close to vertical (i.e. parallel to the earth's radius) whereas in FIG. 10 the tool axis 24 is horizontal.

Curves A and B in FIG. 11 show accelerometer maximum outputs (peak to peak differences) for different tool axis tilt conditions (abcissa). Curve A is for an accelerometer cant angle $\phi=20°$, and curve B is for $\phi=30°$. Curves C and D show algebraic sum outputs of the accelerometer, for 20° and 30° cant angles, respectively.

In FIG. 11, curves A and B show that, at small tool axis tilt angles, the output sensitivities are close to the sensitivities that would be achieved with an accelerometer mounted to have zero cant of its output axis (i.e. its output axis normal to the tool rotation axis). Indeed, at lower tilt angles, one may measure peak-to-peak voltage output from the accelerometer, as it is rotated, and obtain the phase shift (relative to a plane containing the earth's axis and intersecting the accelerometer) in a useful manner.

For high tool axis tilt angles (in FIG. 11), the peak-to-peak voltage change (change in ordinates of curves A and B), as the tool tilt angle (bore-hole angle relative to vertical) approaches horizontal, becomes smaller and smaller in correspondence to a 1-cosine function, so that output accuracy becomes less and less. However, because of the cant angle $\phi$, the accelerometer output is asymmetrical about the zero "g" level as it is rotated about axis 24. This asymmetric effect has a (1-cos) function effect at low tool axis tilt angle (see FIG. 9) and becomes a sine function effect at high tilt angles (see FIG. 10). Therefore, the average signal from the canted accelerometer provides a good leverage factor to measure high tilt angles accurately.

Referring again to FIG. 1, the invention enables one to look at the complete sine wave generated by a sensor such as a gyro or accelerometer rather than just one point. In addition, since the carouseling rate can be precise, one knows that all data must fit a perfect sine wave of a known period. Additional statistical leverage is gained using filter techniques and by other means. In addition, many error terms from the sensor, such as bias related errors, are eliminated.

Carouseling of a single accelerometer gains all these benefits and permits a lower basic cost single accelerometer to do the same job as two much more accurate fixed accelerometers. Mounting this accelerometer with a cant angle and rotating it accomplishes the same thing as three fixed accelerometers.

The cant angle selected would, in practice, be determined by application factors. For instance, it is very often the case that high tilt angles occur only at the terminal point of a bore-hole. In such cases, high tilt angle error does not propogate as rapidly as does a low tilt angle error at the beginning of the hole. On the other hand, if the hole has a very high tilt angle throughout a large portion of its length, one would be more concerned about high tilt angle accuracy and thus a higher cant angle would be chosen. These considerations illustrate the criticality of cant angle selection between 5° and 40°, relative to a plane normal to the axis of rotation of the acelerometer.

FIG. 6 shows a tilted accelerometer 21 as in FIG. 1, in combination with a gyroscope 25' which is also tilted (relative to axis 24) as and for the purposes described in U.S. patent application Ser. No. 924,931 filed July 17, 1978 by Donald H. Van Steenwyk. Thus, the spin rotor of the gyro has spin axis components along travel axis 24 and in a direction normal to axis 24. Accordingly the benefits of both gyroscope and accelerometer tilting or canting are achieved, simultaneously.

In both FIGS. 1 and 6, the gyroscope may take the form of either of the gyroscopes $G_1$ or $G_2$ described in U.S. patent application Ser. No. 970,625 filed Dec. 18, 1978 by Donald H. Van Steenwyk.

FIG. 12 shows a first tilted accelerometer 121 as in FIG. 1, in combination with a second tilted accelerometer 121, the direction of tilt of 121 being orthogonal to that of 121 (i.e. if 121 is tilted to the right so that its tilt sensitive axis extends to the right and downward in FIG. 12), 122 is tilted toward the viewer with its tilt sensitive axis extending toward the viewer and downwardly. Motor 22 drives both accelerometers about axis 24 of shaft 23 which typically extends in the direction of the borehole. Such use of two orthogonally tilted accelerometers provides greater precision of measurement in that the two simultaneous outputs may be averaged, or the two outputs (or their components) can both be used separately and compared or cross-checked. Thus, for example, the two outputs will be 90° out of phase at any given time, and can be cross-checked. Also, if the drive motor M fails, carrier 18 may be rotated about axis 24, and readings of the outputs of the two accelerometers taken and compared or averaged, for enhanced accuracy. Carrier 18 may be considered as attached to or integral with a drill stem or well pipe that is rotated. The stem or pipe may be successively rotated and stopped, and readings taken during the stop intervals to produce successive points on output curves.

A means to process the outputs of both accelerometers, as described, is indicated at 130 in FIG. 12. Input leads from the two accelerometers are indicated at 131 and 132.

I claim:

1. In a borehole navigation apparatus, the combination comprising (a) a carrier movable lengthwise in the borehole, (b) means on the carrier defining an axis of rotation, (c) a tilt sensitive device located interiorly of the carrier and having a sensitive axis for sensing tilt, said axis extending in a cant direction having components respectively along said axis of rotation and also along perpendiculars to said axis of rotation, such device being rotatable about said axis of rotation, (d) drive means on the carrier for rotating said device about said axis of rotation, the extent of said cant remaining fixed during said rotation, and (e) said device having an output which varies as a function of said rotation, and including means for processing said output.

2. The combination of claim 1 wherein said carrier defines an axis of travel lengthwise of the borehole, and said axis of rotation is parallel to said axis of travel.

3. The combination of claim 2 wherein said axis of rotation is coincident with said axis of travel.

4. The combination of claim 1 wherein said device has an output which varies as a function of said rotation, and including means for processing said output.

5. In a borehole navigation apparatus, the combination comprising (a) a carrier movable lengthwise in the borehole, (b) means on the carrier defining an axis of rotation, and (c) a tilt sensitive device located interiorly of the carrier and having a sensitive axis for sensing tilt, said sensitive axis extending in a cant direction having components respectively along said axis of rotation and also along a perpendicular to said axis of rotation, such device being rotatable about said axis of rotation, (d) and a second tilt sensitive device on the carrier and having a sensitive axis for sensing tilt, said sensitive axis of said second device extending in a cant direction having components respectively along said axis of rotation and also along a perpendicular to said axis of rotation, such device being rotatable about said axis of rotation, said two sensitive axes of said two devices respectively being orthogonally related relative to said axis of rotation.

6. The combination of claim 5 including drive means on the carrier connected to simultaneously rotate said devices about said axis of rotation while their sensitive axes remain orthogonally related as aforesaid, one of said devices located above the other.

7. The combination of claim 6 wherein the devices have outputs which vary as a function of said rotation, and including means for processing said outputs for comparison.

8. In navigation apparatus, the combination comprising (a) a carrier movable lengthwise, (b) means on the carrier defining an axis of rotation, said means including a drive, (c) a tilt sensitive device located interiorly of the carrier to be rotated about said axis by said drive, said device having a sensitive axis for sensing tilt, said sensitive axis extending in a cant direction having components respectively along said axis of rotation and also along perpendiculars to said axis of rotation, the extent of said cant remaining fixed and predetermined during such rotation, (d) said device having an output which varies as a function of said rotation, and including means for processing said output.

9. The apparatus of claim 1 including a second tilt sensitive device on the carrier and rotatable about said axis of rotation.

10. The apparatus of claim 9 wherein said second tilt sensitive device has a sensitive axis which is tilted in a cant direction orthogonally related to the sensitive axis of said first device.

11. The apparatus of claim 9 wherein said devices comprise accelerometers.

12. In a borehole navigation apparatus, the combination comprising (a) a carrier movable lengthwise in the borehole, (b) means on the carrier defining an axis of rotation, (c) a first tilt sensitive device located interiorly of the carrier and having a sensitive axis for sensing tilt, said sensitive axis extending in a cant direction having components respectively along said axis of rotation and also along a perpendicular to said axis of rotation, such device being rotatable about said axis of rotation, (d) and a second tilt sensitive device on the carrier and having a sensitive axis for sensing tilt, said second device being rotatable relative to said axis of rotation, said two sensitive axes of said two devices extending in non-parallel relation.

13. The combination of claim 12 including drive means on the carrier connected to simultaneously rotate said devices about said axis of rotation while their sensitive axes remain related to aforesaid, one of said devices located above the other.

14. The combination of claim 13 wherein the devices have outputs which vary as a function of said rotation, and including means for processing said outputs for comparison.

15. The combination of claim 12 wherein said devices comprise accelerometers.

16. In a borehole navigation apparatus, the combination comprising (a) a carrier movable lengthwise in the borehole, (b) means on the carrier defining an axis of rotation, (c) a first tilt sensitive device located interiorly of the carrier and having a sensitive axis for sensing tilt extending in a first cant direction having components respectively along said axis of rotation and also along perpendiculars to said axis of rotation, said first device being rotatable about said axis of rotation, (d) a second tilt sensitive device located interiorly of the carrier and having a sensitive axis for sensing tilt extending in a second cant direction having components respectively along said axis of rotation and also along perpendiculars to said axis of rotation, said second device being rotatable about said axis of rotation, said second cant direction being out of parallel with respect to said first cant direction, and (e) drive means on the carrier for rotating said devices about said axis of rotation, the relationships of cants of said device sensitive axes, remaining known during said rotation.

17. The combination of claim 16 wherein said devices comprise accelerometers or the like.

* * * * *